US007379558B2

(12) United States Patent
Proni

(10) Patent No.: US 7,379,558 B2
(45) **Date of Patent: *May 27, 2008**

(54) LOUDSPEAKER WITH INTEGRATED SPIDER STANDOFF RING

(75) Inventor: Lucio Proni, Weston, FL (US)

(73) Assignee: JL Audio, Inc., Miramar, FL (US)

( * ) Notice: Subject to any disclaimer, the term of this patent is extended or adjusted under 35 U.S.C. 154(b) by 419 days.

This patent is subject to a terminal disclaimer.

(21) Appl. No.: 11/013,766

(22) Filed: Dec. 16, 2004

(65) Prior Publication Data

US 2006/0133637 A1 Jun. 22, 2006

(51) Int. Cl.
*H04R 1/00* (2006.01)
*H04R 1/02* (2006.01)

(52) U.S. Cl. ..... 381/404; 381/394

(58) Field of Classification Search ..... 381/394, 381/396, 403, 404, 392, 395, 400, 409; 181/171, 181/172

See application file for complete search history.

(56) References Cited

U.S. PATENT DOCUMENTS

| | | | | |
|---|---|---|---|---|
| 2,090,025 | A | 8/1937 | Brennan | 179/115.5 |
| 2,221,068 | A | 11/1940 | Alons | 179/115.5 |
| 2,295,483 | A | 9/1942 | Knowles | 179/115.5 |
| 2,318,517 | A | 5/1943 | Olson | 179/115.5 |
| 2,812,825 | A | 11/1957 | Matthews | 181/31 |
| 2,924,290 | A | 2/1960 | Zuerker | 181/32 |
| 3,118,972 | A | 1/1964 | Walczak | 179/1 |
| 3,892,289 | A | 7/1975 | Rollins | 181/171 |
| 4,331,841 | A | 5/1982 | Castagna | 179/146 E |
| 5,014,323 | A | 5/1991 | Markow et al. | 381/194 |
| 5,455,396 | A | 10/1995 | Willard et al. | 181/172 |
| 6,385,327 | B1 * | 5/2002 | D'Hoogh | 181/171 |
| 6,731,773 | B1 | 5/2004 | Bergbower et al. | 381/397 |
| 6,735,323 | B1 | 5/2004 | Chang | 381/404 |
| 6,922,477 | B1 * | 7/2005 | Ikeyama | 381/400 |
| 2003/0156731 | A1 | 8/2003 | Sato | 381/398 |
| 2004/0008860 | A1 | 1/2004 | Wu | 381/404 |
| 2004/0218778 | A1 | 11/2004 | Weisman | 381/396 |
| 2005/0180590 | A1 * | 8/2005 | Proni | 381/396 |

FOREIGN PATENT DOCUMENTS

| | | |
|---|---|---|
| FR | 2 836 771 | 9/2003 |
| GB | 2 392 795 | 3/2004 |
| JP | 55-071394 | 5/1980 |

* cited by examiner

*Primary Examiner*—Brian Ensey
(74) *Attorney, Agent, or Firm*—GrayRobinson, P.A.

(57) ABSTRACT

A loudspeaker is provided in which the outer diameter or foot of the spider is over molded with a standoff formed of a plastic material in an injection molding tool so that the spider and standoff form an integral unit. The standoff, in turn, is glued or otherwise affixed to the frame of the speaker to provide accurate centering of the voice coil relative to the magnetic gap of the motor structure.

5 Claims, 7 Drawing Sheets

LOUDSPEAKER WITH INTEGRATED SPIDER STANDOFF RING

FIELD OF THE INVENTION

This invention relates to loudspeakers, and, more particularly, to a loudspeaker in which the outer periphery of the lower suspension is integrally molded with a plastic ring or standoff, which, in turn, is mounted to the frame of the speaker.

BACKGROUND OF THE INVENTION

Loudspeakers generally comprise a frame, a motor structure, a diaphragm, a lower suspension or spider and a surround or upper suspension. In one type of speaker, the motor structure includes a permanent magnet sandwiched between a top plate and a back plate, with a pole piece centrally mounted on the back plate so that both the top plate and magnet are concentrically disposed about the pole piece. A magnetic gap is formed between the pole piece and top plate within which a voice coil is axially movable. Preferably, the voice coil consists of a hollow, cylindrical-shaped former having an inner surface and an outer surface which mounts a winding of wire.

The voice coil is mounted within the magnetic gap by the upper and lower suspensions and the diaphragm. One end of the diaphragm is connected to the surround, which, in turn, is mounted to the upper end of the frame. The spider is connected at one end to the frame at a point between its upper and lower ends. The free ends of the diaphragm and spider are mounted to the outer surface of the former of the voice coil and support it for axial movement within the magnetic gap.

In the course of operation of speakers of the type described above, electrical energy is supplied to the voice coil causing it to axially move within the magnetic gap. The voice coil, diaphragm, surround and spider collectively form a "moving assembly" which reciprocates as a unit with the excursion of the voice coil.

To achieve highest magnetic efficiency in a loudspeaker, the magnetic gap must have a small area with tight tolerances. If the voice coil deviates appreciably from its axial path within the magnetic gap, the voice coil can contact the pole piece or top plate of the motor structure causing significant damage to the speaker. The spider permits free travel of the moving assembly while maintaining it in a centered position with respect to the magnetic gap. During excursion of the voice coil, the spider "tightens up" or stretches to an outer limit of displacement thus limiting the overall extent of excursion permitted and protecting the moving assembly from contacting other parts of the loudspeaker. Additionally, the spider is primarily responsible for exerting a restoring force on the voice coil so that it moves toward the "rest" position within the magnetic gap, i.e. where the voice coil is located when the speaker is not operating, which has a direct impact on distortion performance.

In most speaker designs, spiders are geometrically formed pieces of a cloth-like material. A resin is applied to the material before the forming operation in an attempt to ensure that the final shape of the spider is maintained. The shape of the spider is important because it determines the centering and excursion control performance of the spider.

The spider is typically glued along its inner diameter to the outer surface of the former of the voice coil. A generally flat ring section or foot is formed along the outer diameter of the spider, which, in most speaker designs, is glued to the frame. Typically, these gluing operations take place within the loudspeaker frame as an aid to fixturing the various parts in the proper spatial orientation. The spider-to-frame glue joint is especially critical because it provides the reference point for centering and axial movement of the voice coil as well as the rest of the moving assembly.

For various reasons, but most often as a result of shipping and handling, the spiders which are provided by manufacturers for assembly in loudspeakers may not be flat. That is, the attachment foot along the outer diameter of the spider often does not lie in the same plane. This geometric deformation of the spider foot not only compromises performance of the spider, but it can adversely affect the glue joint between the spider foot and frame. While some areas of the foot contact the frame and can be securely glued in place, other areas of the foot may be slightly separated from the frame resulting in a less glue-foot contact than is desired.

The problem of attaching a geometrically deformed spider foot to the speaker frame cannot be satisfactorily overcome by merely pressing the foot down onto the frame during assembly. Typically, a bead of glue is first applied to the frame and then the spider is brought into contact with the glue. Due to the nature of the glues used for the spider foot-frame joint connection, applying pressure to the foot to force it down onto the frame during assembly would cause the glue on the frame to "squirt out" from between the spider foot and frame. The displaced glue may cover the spider, thus comprising its performance, or spill onto other areas of the speaker. As a result, a relatively thick glue bead is typically used to try to ensure all areas of the spider foot are bonded to the frame. However, the glue bead itself can create geometrically uneven areas along the spider foot, particularly if the glue bead is applied unevenly to the frame.

Another problem with prior art speakers involves failure of the joint connection between the spider foot and frame. When the moving assembly approaches the limits of its excursion, a force is exerted on the spider-to-frame glue joint as the spider acts to pull the moving assembly back toward the neutral position. Since the spider is made of a cloth-like material, this glue joint is susceptible to "peel." Starting at the inner diameter of the frame glue joint, it has been found that the spider can gradually peel away from the surface of the frame particularly in high excursion speakers such as subwoofers. If the spider detaches in one area, it's just a matter of time until the loudspeaker fails.

SUMMARY OF THE INVENTION

This invention is directed to a loudspeaker in which the foot of the spider is over molded with an annular plastic ring or standoff in an injection molding tool so that the spider and standoff form an integral unit. The standoff, in turn, is glued or otherwise affixed to the frame of the speaker to provide accurate centering of the voice coil relative to the magnetic gap of the motor structure.

This invention is predicated on the concept of ensuring that the outer diameter of the spider is flat and can be securely mounted to the speaker frame. As noted above, the spider foot is over molded with a plastic ring or standoff to form an integral unit. During the molding operation, the spider is clamped in a flat position by an injection molding tool to ensure its dimensional and geometric integrity. This molding operation further provides for precise concentricity of the standoff and spider. The standoff can then be glued or otherwise affixed to the frame to obtain a secure connection at that joint, and to accurately locate the spider so that the voice coil is centered relative to the magnetic gap of the motor structure of the speaker.

In one embodiment, the standoff is glued to the speaker. Alternatively, metal pins are placed in the injection molding tool and over molded with the standoff and spider foot. A portion of these metal pins protrude from the bottom surface of the standoff and are inserted within corresponding locator holes formed in the frame to properly position the spider. In another embodiment, the injection molding tool may be configured to form integral plastic pins extending from the bottom surface of the standoff which function in the same fashion as the metal pins noted above.

Using metal or plastic locator pins, the standoff is glued in position to the frame. The assembler may press down on the standoff during the gluing operation to ensure that a tight joint is created with the glue evenly distributed because the spider foot is embedded in the standoff and remains out of contact with the glue. As an alternative to a glue attachment, the standoff may be formed with a number of internal locator holes extending upwardly from its bottom surface which align with holes in the frame. Screws are then inserted through the frame holes into the standoff to secure it in place without the use of glue.

The use of a plastic ring or standoff to secure the spider foot allows for flexibility in the type of frame which can be used. Typically, speaker frames have a continuous spider plateau or seat which supports and connects to the spider foot. With the standoff of this invention, a frame having spaced arms may be employed with each arm being formed with a hole to receive a screw for attachment to the standoff as noted above. Alternatively, the standoff may be glued to the frame arms.

Another advantage of the standoff of this invention is that other elements may be over molded with the standoff and spider foot for mounting to the frame. For example, electrical terminals may be inserted in the injection molding tool and integrally attached to the standoff. When standoff is mounted to the frame, such terminals may be used to receive lead wires from the voice coil.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figures 1, 2:
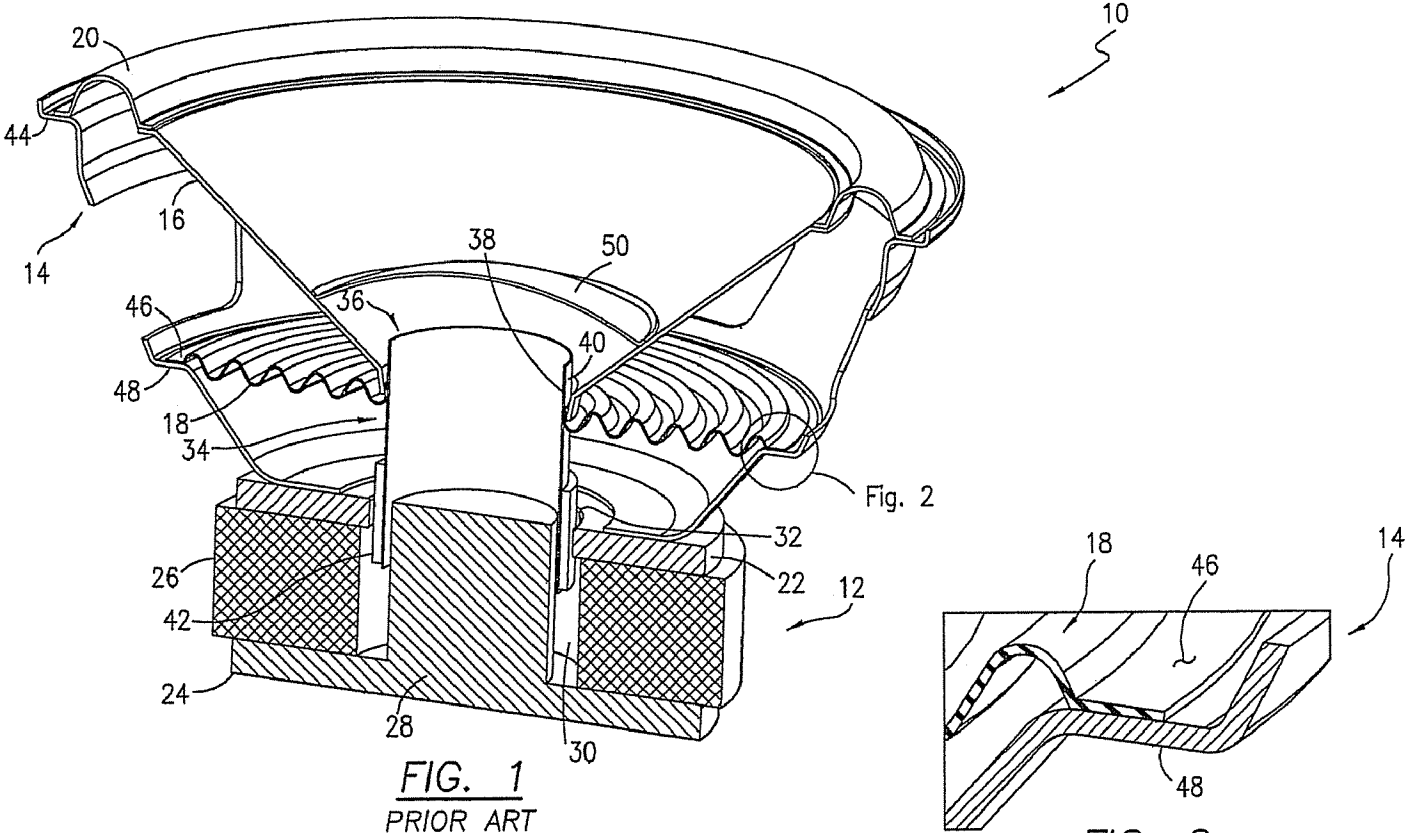
FIG. 1 PRIOR ART
FIG. 2 PRIOR ART
FIG. 1 is a cross sectional view of a prior art loudspeaker employing a typical connection between the outer diameter of the spider and the speaker frame.
FIG. 2 is an enlarged view of the encircled portion of FIG. 1 showing the connection between the spider foot and frame.
Figures 3, 4:
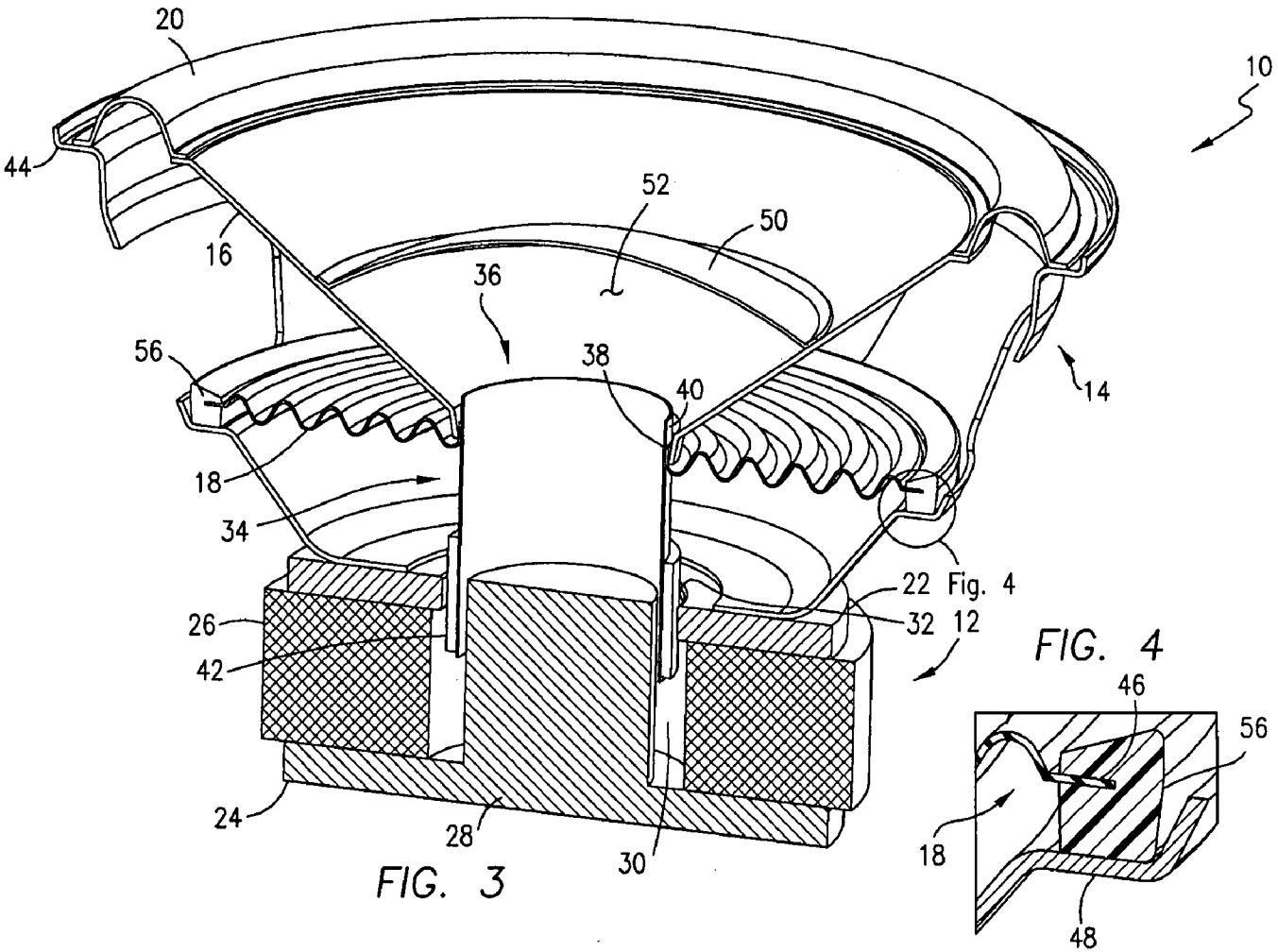
FIG. 3 is a view similar to FIG. 1 but depicting the spider-standoff arrangement of this invention.
FIG. 4 is an enlarged view of the encircled portion of FIG. 3.

Referring initially to FIGS. 1 through 4, a loudspeaker 10 is illustrated which, in FIG. 1, includes a standard, prior art connection between the spider and frame, as described below, and in FIG. 3 an improved means of connecting the spider to the frame according to the present invention.

The speaker 10 generally comprises a motor structure 12, a frame 14 mounted to the motor structure 12, a diaphragm 16, a lower suspension or spider 18 and an upper suspension or surround 20. Conventionally, the motor structure 12 includes a top plate 22 and a back plate 24 which are spaced from one another and mount a permanent magnet 26 between them. A pole piece 28 is integrally formed with and extends upwardly from the back plate 24 into a central bore 30 formed in both the magnet 26 and top plate 22. A magnetic gap 32 is formed between the top plate 22 and the pole piece 28. A voice coil 34 is also provided which includes a hollow, cylindrical-shaped former 36 having an inner surface 38 and an outer surface 40 which mounts a wire winding 42. The former 36 is concentrically disposed about the pole piece 28, and the voice coil 34 is axially movable within the magnetic gap 32 during operation of the speaker 10.

The voice coil 34 is held in place with respect to the pole piece 28 by the diaphragm 16, spider 18 and surround 20. The inner diameter of the diaphragm 16 is affixed to the former 36 by adhesive or the like, and its outer diameter connects to the surround 20. The surround 20, in turn, is mounted to the upper end 44 of the frame 14 as shown. In the prior art speaker 10 shown in FIGS. 1 and 2, the spider 18 is connected to the outer surface 40 of the former 36 along its inner diameter, and a foot 46 formed at the outer diameter of the spider 18 is glued directly to a seat or spider plateau 48 formed in the frame 14.

A dust cap 50 is mounted to the diaphragm 16 in position to overlie the voice coil 34 and pole piece 28 in order to protect such elements from dirt, dust and other contaminants. A dust cap cavity is therefore formed in the area defined by the lower portion of the diaphragm 16, the dust cap 50, the voice coil 34 and the pole piece 28. In response to the input of electrical energy to the wire winding 42, the voice coil 34 is moved axially with respect to the fixed motor structure 12. Because the diaphragm 16, spider 18, surround 20 and dust cap 50 are operatively connected to the voice coil 34, such elements also move with the excursion of the voice coil 34 forming a moving assembly.

Referring now to FIGS. 3 through 13, the loudspeaker 10 is depicted with alternative embodiments of a novel means of mounting the spider foot 46 to the frame 14 according to this invention. Each embodiment is described separately below with reference to specific Figs., it being understood that structure of the loudspeaker 10 common to each embodiment, and to the prior art speaker shown in FIGS. 1 and 2, is given the same reference numbers throughout.

In the embodiment of FIGS. 3 and 4, the foot 46 of spider 18 is over molded with an annular plastic ring or standoff 56 to form an integral joint connection between the two. For purposes of this discussion, the term "over molded" refers to a process in which an item already formed is placed in a mold and then becomes integrally attached to an object formed in the mold. The spider foot 46 is placed in a plastic injection molding tool (not shown) where it is clamped in place in a flat position, and then molten plastic is injected into the mold. The molten plastic flows over and around the spider foot 46 and cools to form the standoff 56, which because of the plastic injection molding tool, is precisely concentric to the foot 46. Consequently, the foot 46 of the spider 18 is concentrically embedded within the standoff 56 forming a joint connection which is not susceptible to peeling or other break down of the layers of the cloth-like material forming the spider 18.

In this embodiment, the standoff 56 is affixed to the spider plateau 48 with a bead of glue. Although the bottom surface of the standoff 56 is substantial planar, in the event of any irregularities between the standoff 56 and spider plateau 48 the standoff 56 may be pressed downwardly against the plateau 48 and the bead of glue thereon. Even if the glue squirts out from between the standoff 56 and plateau 48, it will not cover any portion of the spider foot 46 or other area of the spider 18 since the spider foot 46 is spaced from the bottom surface of the standoff 56 as best seen in FIG. 4.

Figures 5, 6:
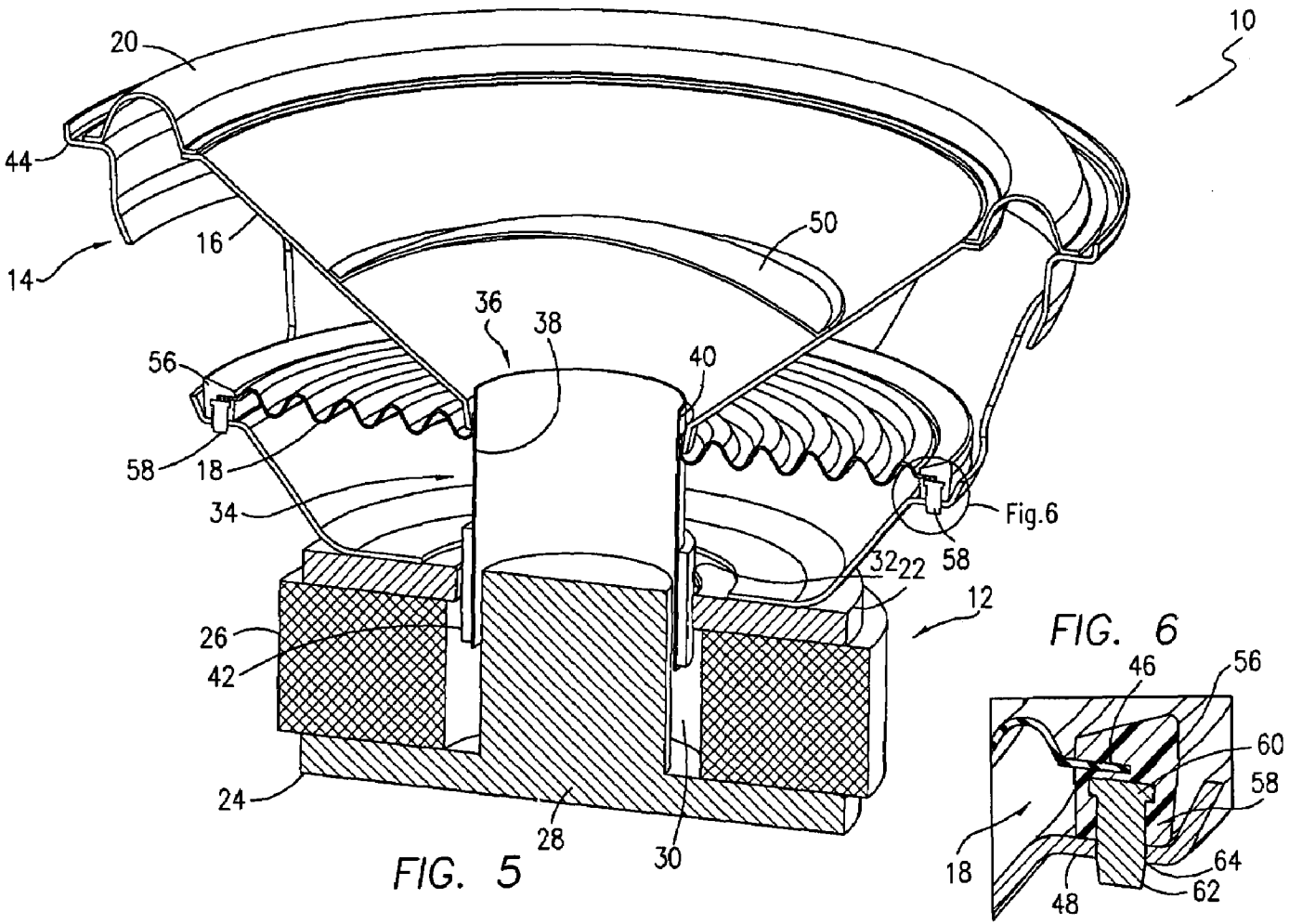
FIG. 5 is a view similar to FIG. 3 depicting an alternative arrangement for mounting the standoff to the speaker frame.
FIG. 6 is an enlarged view of the encircled portion of FIG. 5.

The embodiments of this invention shown in FIGS. 5-8 depict related, alternative arrangements for locating the standoff 56 in the proper position along the spider plateau 48. In FIGS. 5 and 6, the standoff 56 is provided with a number of circumferentially spaced metal pins 58, two of which are shown in the drawings, each having a head section 60 embedded within the standoff 56 and a stem section 62, a portion of which protrudes from the bottom surface of standoff 56. The metal pins 58 are placed in the injection molding tool with the spider 18 and over molded with the standoff 56. Each pin 58 is received within a locator hole 64 formed in the spider plateau 48 which ensures that the spider 18 is placed in the proper position to center the voice coil 34 within the magnetic gap 32.

Figures 7, 8:
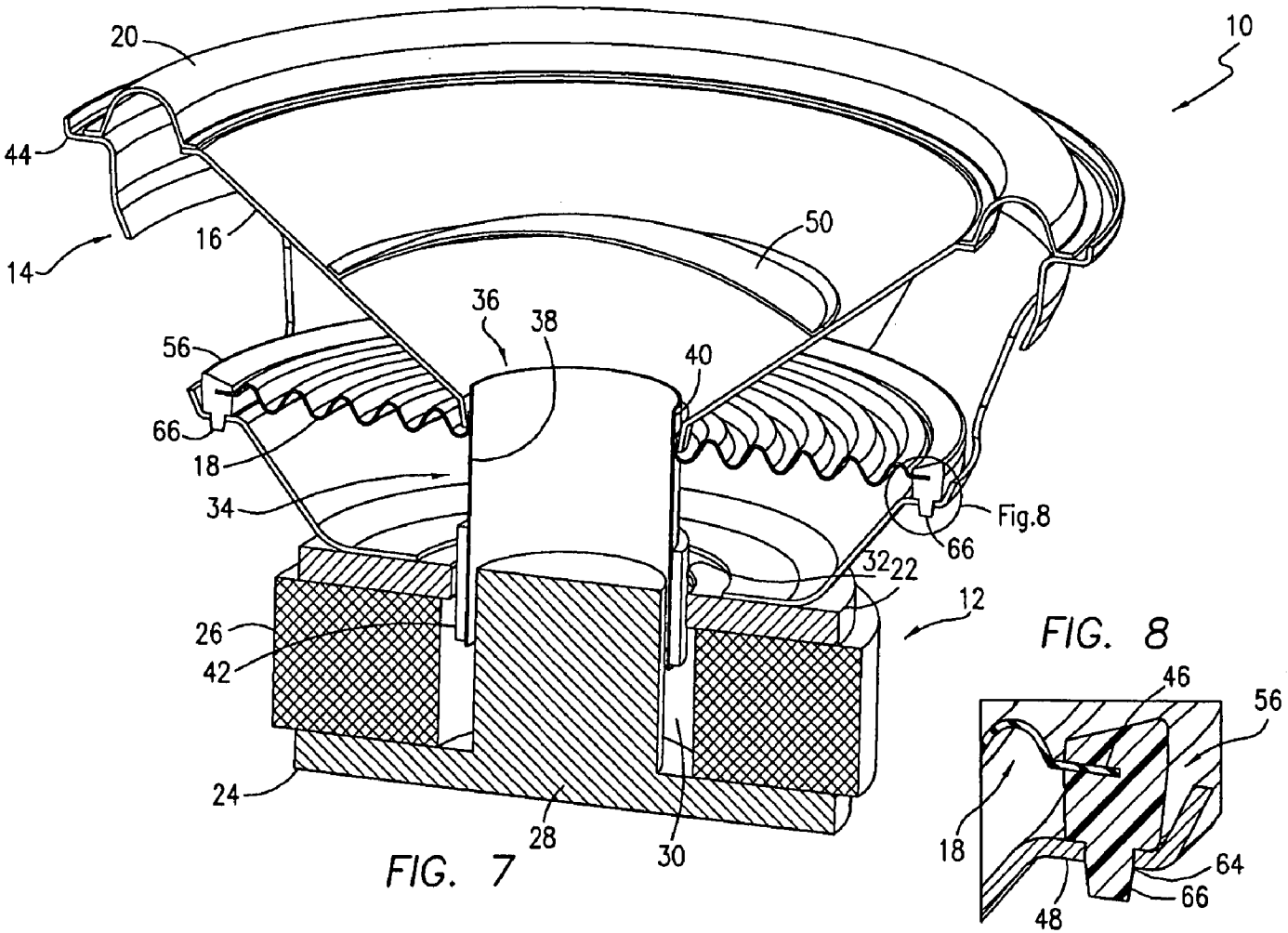
FIG. 7 is a view similar to FIG. 3, except showing another structure for mounting the standoff to the speaker frame.
FIG. 8 is an enlarged view of the encircled portion of FIG. 7.

Alternatively, as shown in FIGS. 7 and 8, plastic pins 66 are integrally molded in the standoff 56 at spaced intervals along its circumference. The injection molding tool is formed with wells (not shown) to form the pins 66 during the molding operation. These pins 66 are inserted within the locator holes 64 in the spider plateau 48 in the same manner and for the same purpose as the metal pins 58 of FIGS. 5 and 6. In each of the embodiments of FIGS. 5-8, the standoff 56 is affixed to the spider plateau 48 by glue.

Figures 9, 10:
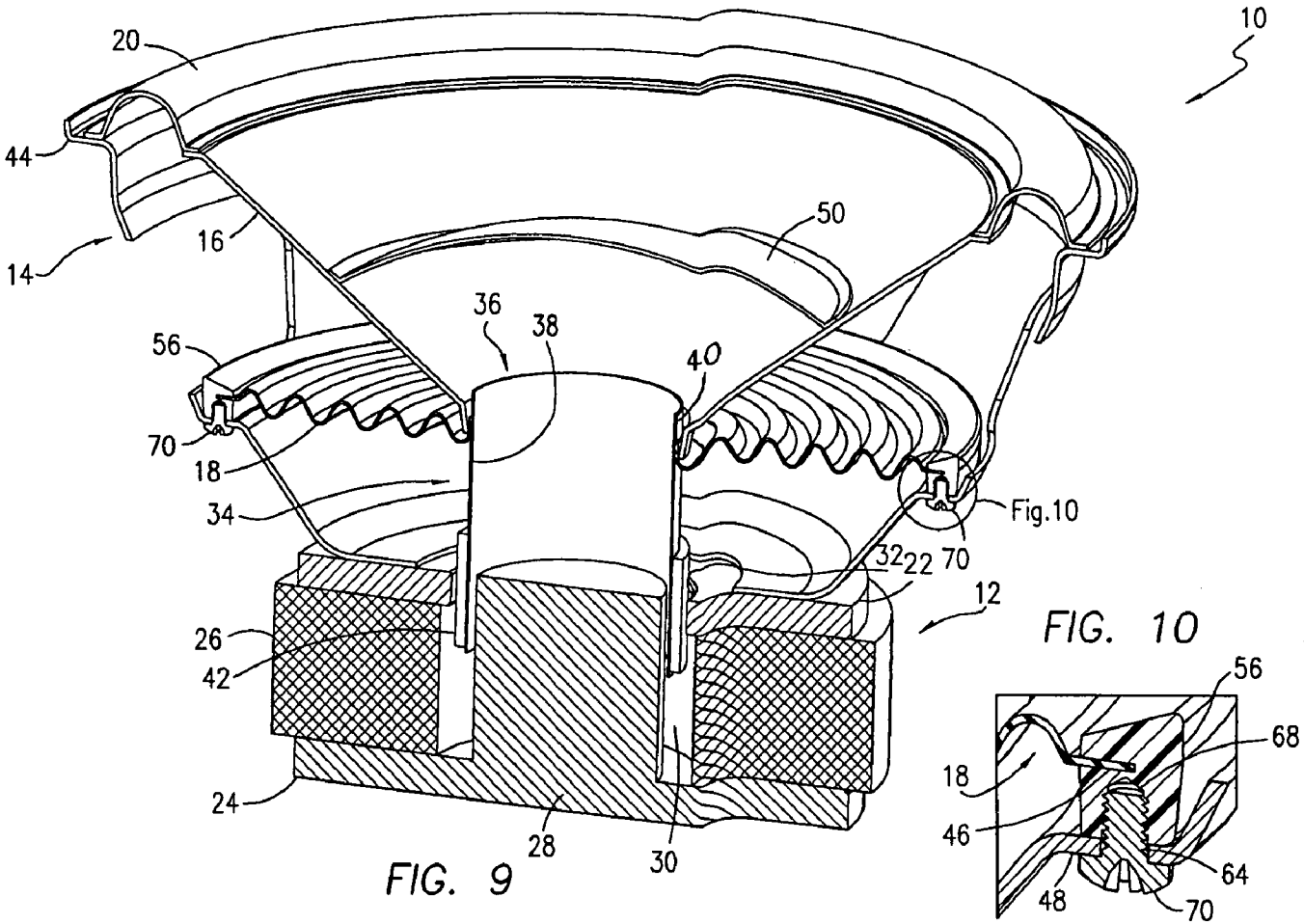
FIG. 9 is a view similar to FIG. 3 illustrating a still further structure for attaching the standoff to the speaker frame.
FIG. 10 is an enlarged view of the encircled portion of FIG. 9.

Referring now to FIGS. 9 and 10, the standoff 56 is shown with a number of spaced holes 68 which extend from its bottom surface to a location short of where the spider foot 46 is embedded. Each hole 68 in the standoff 56 aligns with a locator hole 64 in the spider plateau 48 and receives a screw 70. Each screw 70 extends from the underside of the spider plateau 48, through one of the locator holes 64 and then threads into a hole 68 in the standoff 56. The holes 68 may be smooth, in which case self-tapping screws 70 are used, or the holes 68 may be molded with internal threads (not shown). In this embodiment, no glue is need to secure the standoff 56 to the spider plateau 48.

Figures 11, 12:
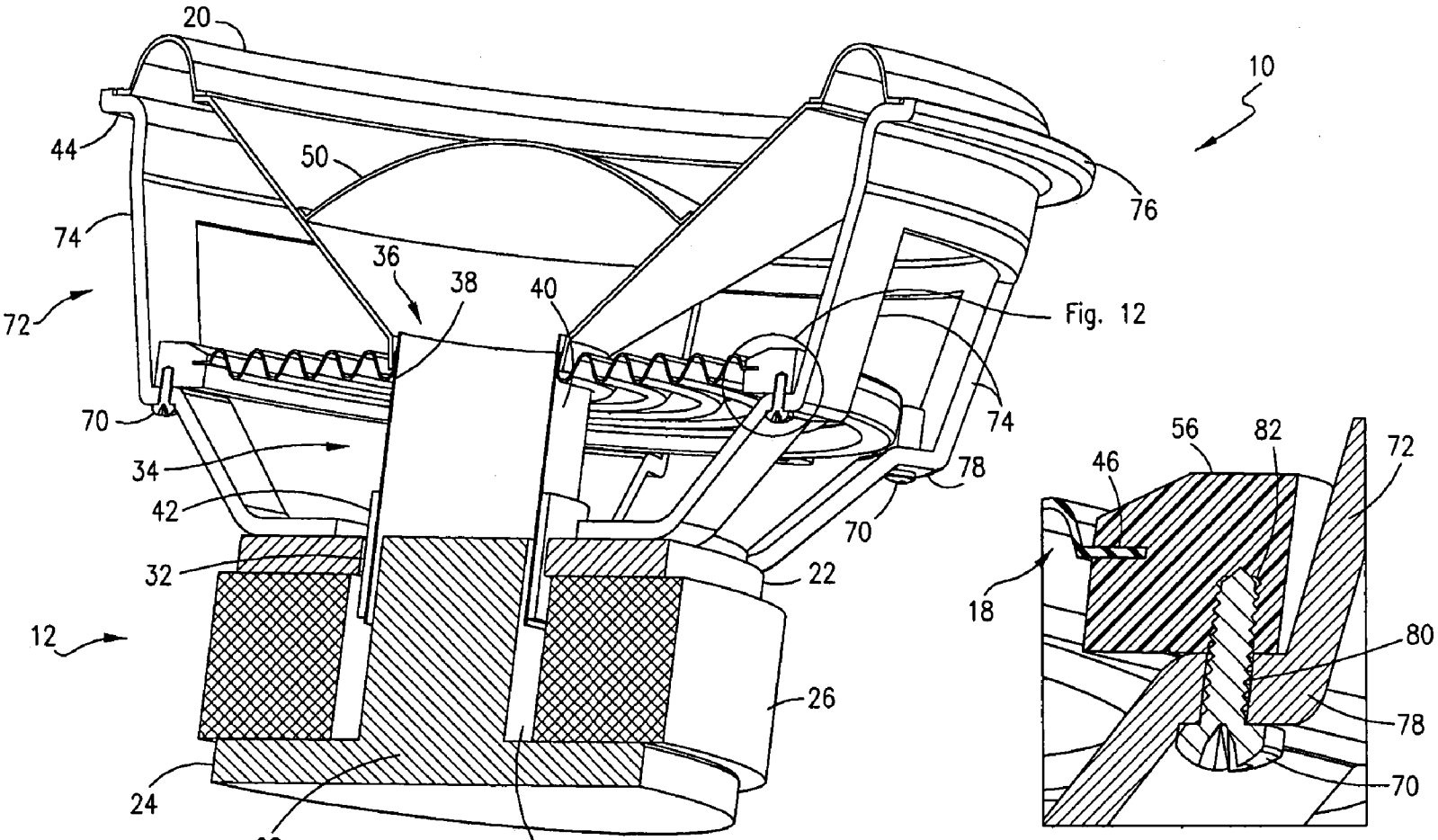
FIG. 11 is a cross sectional view of a loudspeaker having a frame with a number of spaced arms, each of which is mounted to the standoff of this invention.
FIG. 12 is an enlarged view of the encircled portion of FIG. 11.

In each of the embodiments of speaker 10 shown in FIGS. 1-10, the spider plateau 48 of the frame 14 is formed as a continuous circular surface. This construction of the spider plateau is essential in prior art designs because such surface formed the only point of attachment of the spider 18 to the frame 14. The standoff 56 of this invention allows for more flexibility in the design of frames which may be employed, as seen in FIGS. 11 and 12. In that embodiment, a frame 72 is shown which includes a number of circumferentially spaced arms 74 each extending from the top plate 22 of the motor structure 12 to an upper rim 76 of the frame 72. A seat 78 is formed in each arm 74 having a locator hole 80 which aligns with a hole 82 formed in the standoff 56. A screw 70 is provided at each seat 78 to attach the standoff 56 to the frame arms 74 in the same manner as the standoff 56 is attached in FIGS. 9 and 10. Because the spider foot 46 is embedded in the standoff 56, which is a rigid plastic structure, there is no need for continuous attachment along the entire periphery of the foot 46 or standoff 56 to the frame 72.

Figures 13, 14:
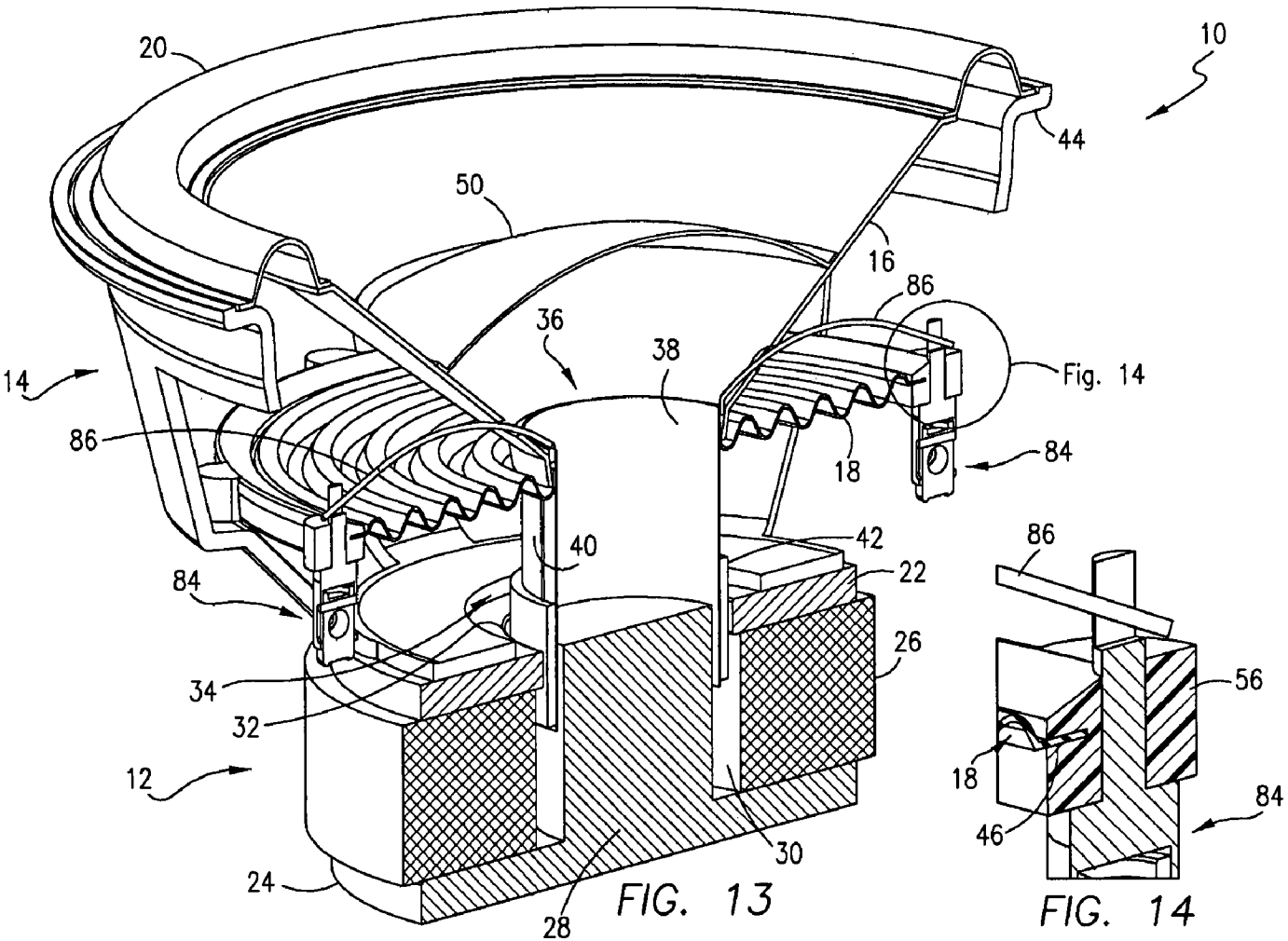
FIG. 13 is a view similar to FIG. 3 showing an electrical connector over molded with the standoff herein.
FIG. 14 is an enlarged view of the encircled portion of FIG. 13.

It is also contemplated that use of the standoff 56 of this invention may permit other speaker elements to be over molded in the injection molding tool, as desired. For example, one or more electrical connectors 84 may be embedded in the standoff 56 to receive the lead wires 86 of the speaker 10 as shown in FIG. 13. This eliminates the need to mount the connectors 84 to another part of the speaker 10 in a separate assembly operation, and provides a convenient and secure connection for same.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. For example, in the embodiments of FIGS. 5-8, metal or plastic pins 58, 66 are employed to locate the standoff 56 on the spider plateau 48 where it is glued in place. It should be understood that screws could be employed instead of glue to secure the standoff 56 to the spider plateau 48. Additionally, the standoff 56 is depicted as being attached by screws 70 to the frame arms 74 in the embodiment of FIGS. 11 and 12. If desired, the standoff 56 could be attached by gluing to the seat 78 of each arm 74 thus eliminating the screws 70.

Therefore, it is intended that the invention not be limited to the particular embodiment disclosed as the best mode contemplated for carrying out this invention, but that the invention will include all embodiments falling within the scope of the appended claims.

What is claimed is:

1. A loudspeaker, comprising:

a motor structure including a voice coil movable within a magnetic gap;

a frame having a spider plateau formed with at least one locator hole;

an upper suspension connected to said frame;

a diaphragm coupled to said upper suspension and to said voice coil;

a lower suspension having a first end coupled to said voice coil and a second end;

a standoff formed of a molded plastic material, said second end of said lower suspension being over molded with said standoff to integrally connect said standoff and said lower suspension, said standoff having at least one pin extending outwardly from a first surface thereof, said standoff being mounted to said frame in position so that said at least one pin is received within said at least one locator hole in said spider plateau and said first surface rests atop said spider plateau.

2. The loudspeaker of claim 1 in which said at least one pin is a pin over molded with said standoff to integrally connect said pin and said standoff.

3. The loudspeaker of claim 1 in which said at least one pin is integrally formed with said standoff upon the molding thereof.

4. A loudspeaker, comprising:

a motor structure including a voice coil movable within a magnetic gap;

a frame having a spider plateau formed with at least one locator hole;

an upper suspension connected to said frame;

a diaphragm coupled to said upper suspension and to said voice coil;

a lower suspension having a first end coupled to said voice coil and a second end;

a standoff formed of a molded plastic material, said second end of said lower suspension being over molded with said standoff to integrally connect said standoff and said lower suspension, said standoff being formed with at least one hole extending from a first surface thereof which is positioned in alignment with said at least one locator hole in said spider plateau;

a fastener extending through said at least one locator hole in said spider plateau and into said at least one hole in said standoff to secure said standoff to said spider plateau.

5. A loudspeaker, comprising:

a motor structure including a voice coil movable within a magnetic gap;

a frame including a number of spaced arms, each of said spaced arms having a seat formed with a locator hole;

an upper suspension connected to said frame;

a diaphragm coupled to said upper suspension and to said voice coil;

a lower suspension having a first end coupled to said voice coil and second end;

a standoff formed of a molded plastic material, said second end of said lower suspension being over molded with said standoff to integrally connect said standoff and said lower suspension, said standoff being formed with a number of holes each extending from a first surface thereof, said holes each being positioned in alignment with said locator holes in one of said seats in said spaced arms of said frame;

a fastener extending through said locator in each of said seats and into an aligning hole of said standoff to secure said standoff to said frame arms.

* * * * *